US009879868B2

(12) United States Patent
Hirakawa et al.

(10) Patent No.: US 9,879,868 B2
(45) Date of Patent: Jan. 30, 2018

(54) INDOOR UNIT OF AN AIR-CONDITIONING APPARATUS WITH GROOVED FLOW STABILIZER

(71) Applicant: Mitsubishi Electric Corporation, Tokyo (JP)

(72) Inventors: Seiji Hirakawa, Tokyo (JP); Takuya Niimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 148 days.

(21) Appl. No.: 14/649,677

(22) PCT Filed: Aug. 28, 2013

(86) PCT No.: PCT/JP2013/072987
§ 371 (c)(1),
(2) Date: Jun. 4, 2015

(87) PCT Pub. No.: WO2014/091798
PCT Pub. Date: Jun. 19, 2014

(65) Prior Publication Data

US 2015/0300663 A1 Oct. 22, 2015

(30) Foreign Application Priority Data

Dec. 13, 2012 (JP) ..... 2012-272262

(51) Int. Cl.
*F25B 29/00* (2006.01)
*F24F 3/06* (2006.01)
(Continued)

(52) U.S. Cl.
CPC ..... *F24F 3/06* (2013.01); *F24F 1/0011* (2013.01); *F24F 1/0025* (2013.01); *F24F 13/22* (2013.01); *F24F 2001/0048* (2013.01)

(58) Field of Classification Search
CPC .. F24F 3/06; F24F 1/0011; F24F 13/22; F24F 1/0025; F24F 2001/0048; F24F 13/222;
(Continued)

(56) References Cited

U.S. PATENT DOCUMENTS 2,122,140 A * 6/1938 Henney ..... B61D 27/0018 62/225
5,873,780 A * 2/1999 Mori ..... F24F 1/0011 454/285
(Continued)

FOREIGN PATENT DOCUMENTS

CN 1955485 A 5/2007
CN 102265098 A 11/2011
(Continued)

OTHER PUBLICATIONS

JP 10170013 A—English Machine Translation.*
(Continued)

*Primary Examiner* — Jianying Atkisson
*Assistant Examiner* — Jose O Class-Quinones
(74) *Attorney, Agent, or Firm* — Posz Law Group, PLC

(57) ABSTRACT

A stabilizer has a tip portion at a boundary between the stabilizer and a nozzle, and a projection on the lower side of the tip portion, and a first recess is formed between the projection and the tip portion in a continuously recessed shape in the longitudinal direction of the cross flow fan.

6 Claims, 4 Drawing Sheets

(51) Int. Cl.
*F24F 13/22* (2006.01)
*F24F 1/00* (2011.01)

(58) Field of Classification Search
CPC .... F24F 2013/221; F24F 13/24; F24F 1/0018; F24F 1/0022; F24F 1/0007; F24F 11/022; F24F 11/025; F24F 7/08
See application file for complete search history.

(56) References Cited

U.S. PATENT DOCUMENTS

| | | | | |
|---|---|---|---|---|
| 2005/0223732 | A1 | 10/2005 | Kim et al. | |
| 2007/0169498 | A1* | 7/2007 | Rios | F24F 13/222 3/222 |
| 2008/0181764 | A1* | 7/2008 | Hirakawa | F04D 17/04 415/53.2 |
| 2010/0058793 | A1* | 3/2010 | Miyamoto | F24F 1/0011 62/291 |
| 2012/0031983 | A1* | 2/2012 | Shirota | F24F 1/0011 236/49.3 |

FOREIGN PATENT DOCUMENTS

| | | | | |
|---|---|---|---|---|
| EP | 1 712 798 | A1 | | 10/2006 |
| JP | 58-49131 | U | | 4/1983 |
| JP | 61180847 | A | * | 8/1986 |
| JP | 62-147823 | U | | 9/1987 |
| JP | 1-112338 | U | | 7/1989 |
| JP | 05-231667 | A | | 9/1993 |
| JP | H06-341663 | A | | 12/1994 |
| JP | 07055182 | A | * | 3/1995 |
| JP | 10-160185 | A | | 6/1998 |
| JP | 10170013 | A | * | 6/1998 |
| JP | H10-170013 | A | | 6/1998 |
| JP | 2000-329367 | A | | 11/2000 |
| JP | 2001-280647 | A | | 10/2001 |
| JP | 2001-289455 | A | | 10/2001 |
| JP | 2007-120833 | A | | 5/2007 |
| JP | 2007-120880 | A | | 5/2007 |
| JP | 2010-078235 | A | | 4/2010 |
| JP | 2010-107095 | A | | 5/2010 |

OTHER PUBLICATIONS

JP 07055182 A—English Machine Translation.*
JP 61180847 A—English Machine Translation.*
Extended European Search Report dated Jul. 13, 2016 issued in corresponding EP patent application No. 13862820.1.
Office Action dated Jul. 18, 2016 issued in corresponding CN patent application No. 201310501538.6 (and English translation).
Office Action dated Oct. 6, 2015 in the corresponding JP application No. 2012-272262 (with English translation).
International Search Report of the International Searching Authority dated Oct. 22, 2013 for the corresponding international application No. PCT/JP2013/072987 (and English translation).
Office Action dated Nov. 27, 2015 in the corresponding CN application No. 201310501538.6 (with English translation).

* cited by examiner

INDOOR UNIT OF AN AIR-CONDITIONING APPARATUS WITH GROOVED FLOW STABILIZER

CROSS REFERENCE TO RELATED APPLICATIONS

This application is a U.S. national stage application of International Application No. PCT/JP2013/072987 filed on Aug. 28, 2013, which claims priority to Japanese Application No. 2012-272262 filed on Dec. 13, 2012, the disclosures of which are incorporated herein by reference.

TECHNICAL FIELD

The present invention relates to an indoor unit of an air-conditioning apparatus, and more specifically, to the shape of a stabilizer.

BACKGROUND ART

Conventional indoor unit of an air-conditioning apparatus may include a stabilizer having a tip portion of a substantially triangular shape (see Patent Literature 1).

CITATION LIST

Patent Literature

Patent Literature 1: Japanese Unexamined Patent Application Publication No. 10-160185 (for example, see FIG. 1)

SUMMARY OF INVENTION

Technical Problem

In this type of conventional indoor unit of the air-conditioning apparatus, dew condensation water generated during cooling operation or dehumidification operation is partially stored in the tip portion of the stabilizer. However, if the amount of dew condensation increases, dew condensation water held in the tip portion increases and overflows, and then drips into an air outlet. As a result, dew may be scattered into a room by an air blown out from the air outlet.

The present invention has been made to overcome the above problem, and an objective of the invention is to provide an indoor unit of an air-conditioning apparatus which is capable of holding dew condensation water in a stabilizer even if a large amount of dew condensation occurs during cooling operation, and preventing dew condensation water from being dripped into the air outlet.

Solution to Problem

An indoor unit of an air-conditioning apparatus according to the present invention includes a fan; a heat exchanger that is disposed so as to surround an upper side and a front side of the fan; a nozzle that is disposed on a lower side of the heat exchanger that is located on a front side of the fan so as to face the fan; and a stabilizer that is disposed on a surface of the nozzle which faces the fan along part of an outer periphery of the fan, wherein the stabilizer has a tip portion at a boundary between the stabilizer and the nozzle and a projection on a lower side of the tip portion, and a first recess is formed between the projection and the tip portion in a continuously recessed shape in the longitudinal direction of the fan.

Advantageous Effects of Invention

In an indoor unit of an air-conditioning apparatus according to the present invention, dew condensation water generated during cooling operation or dehumidification operation is held in the stabilizer so as not to be dripped into the air outlet. Accordingly, it is possible to prevent dew from being scattered into a room by an air blown out from the air outlet.

DESCRIPTION OF EMBODIMENTS

With reference to the drawings, Embodiment of the present invention will be described.

Embodiment

Figure 1:
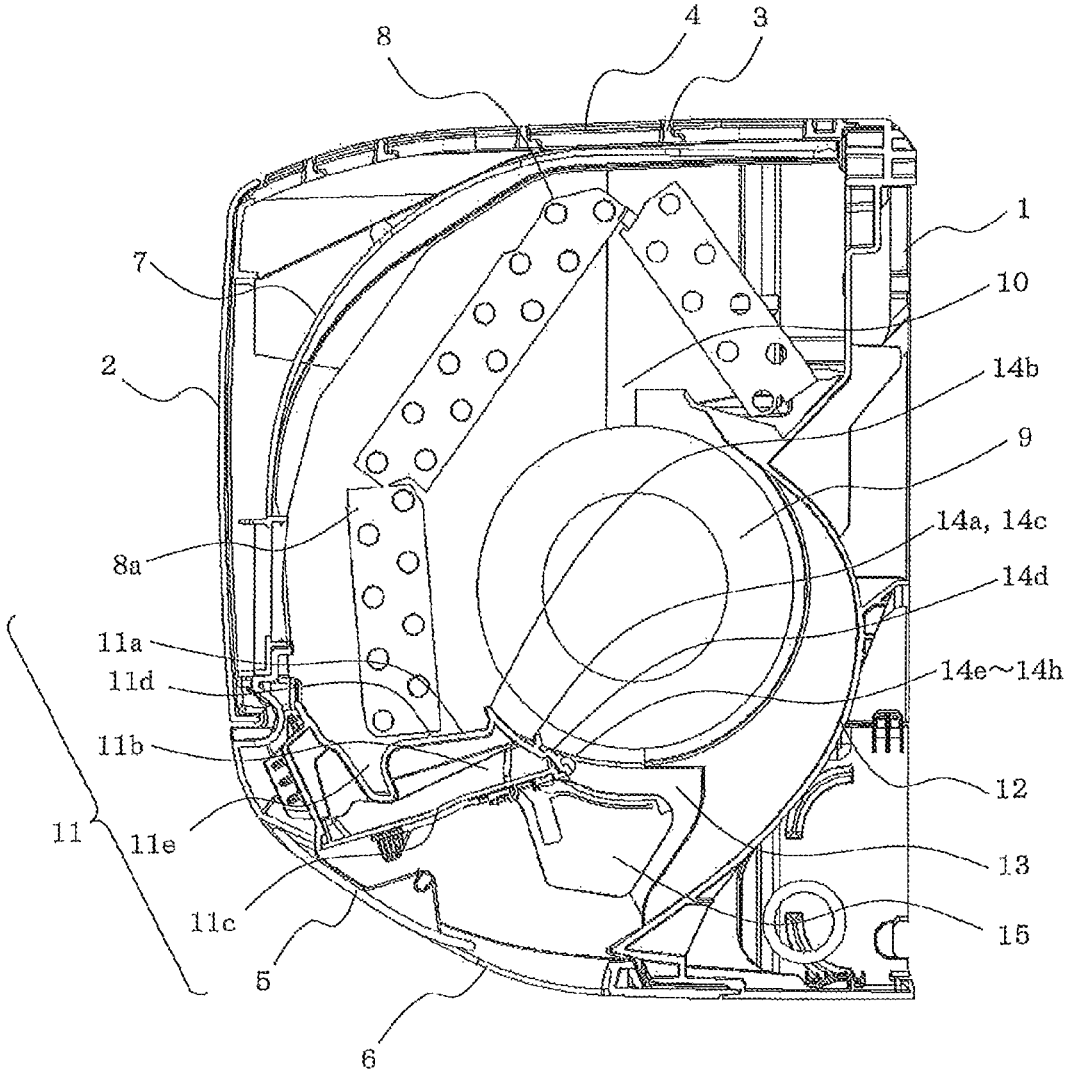
FIG. 1 is a sectional view of an indoor unit of an air-conditioning apparatus according to Embodiment of the present invention.
Figure 2:
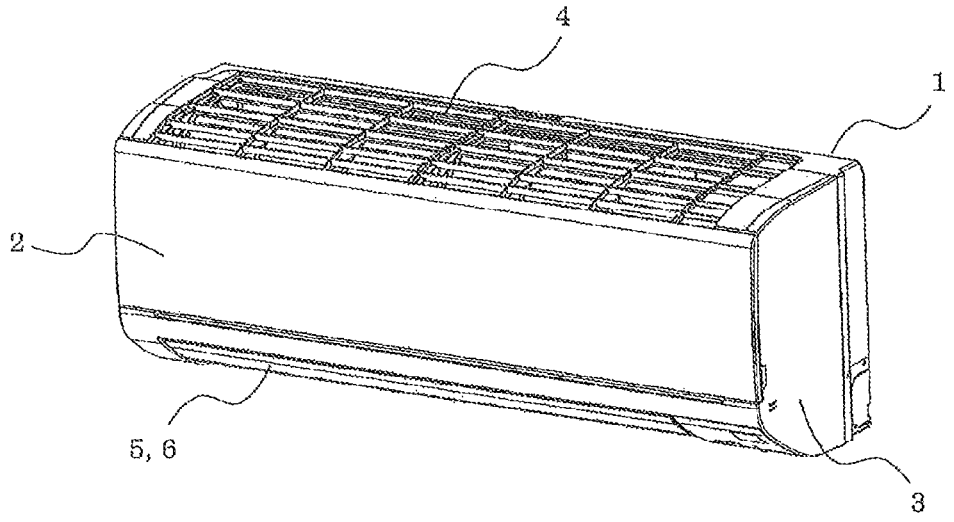
FIG. 2 is a general perspective view of the indoor unit of the air-conditioning apparatus according to Embodiment of the present invention.

FIG. 1 is a sectional view of an indoor unit of an air-conditioning apparatus according to Embodiment of the present invention, and FIG. 2 is a general perspective view of the indoor unit of the air-conditioning apparatus according to Embodiment of the present invention.

In an indoor unit 1 of the air-conditioning apparatus according to Embodiment, an air inlet 4 which is covered with a design grille 2 and a panel 3 is disposed on the upper side of the front face of the indoor unit 1. An air outlet 6 is disposed on the lower side of the front face of the indoor unit 1 and has an opening whose direction and size are regulated by an up-and-down air flow direction variable vane 5. Further, an air channel is formed in the indoor unit 1 so as to extend from the air inlet 4 to the air outlet 6.

A pre-filter 7 that removes foreign matters in the room air, a heat exchanger 8 that exchanges heat of the room air, a cross flow fan 9, and a right-and-left air flow direction variable vane 15 are disposed in the air channel. An inlet air channel 10 for an air which is surrounded by the heat exchanger 8 and the cross flow fan 9 is formed on the upstream side (upper side) of the cross flow fan 9, and an outlet air channel 13 which is separated by a nozzle 11 and a box section 12 is formed on the downstream side (lower side) of the cross flow fan 9. The right-and-left air flow direction variable vane 15 that changes the air flow direction in the right-and-left direction is disposed in the outlet air channel 13. The pre-filter 7 is disposed between the air inlet 4 and the heat exchanger 8 so as to cover the heat exchanger 8 and has a function of collecting dust contained in the air which flows into the air inlet 4 and preventing it from entering the heat exchanger 8.

Furthermore, a portion of the heat exchanger 8 which is located in front of the cross flow fan 9 is referred to as a front heat exchanger 8*a*.

The nozzle 11 (11*a* to 11*e*) and a stabilizer 14 (14*a* to 14*h*) will be described later.

Figure 3:
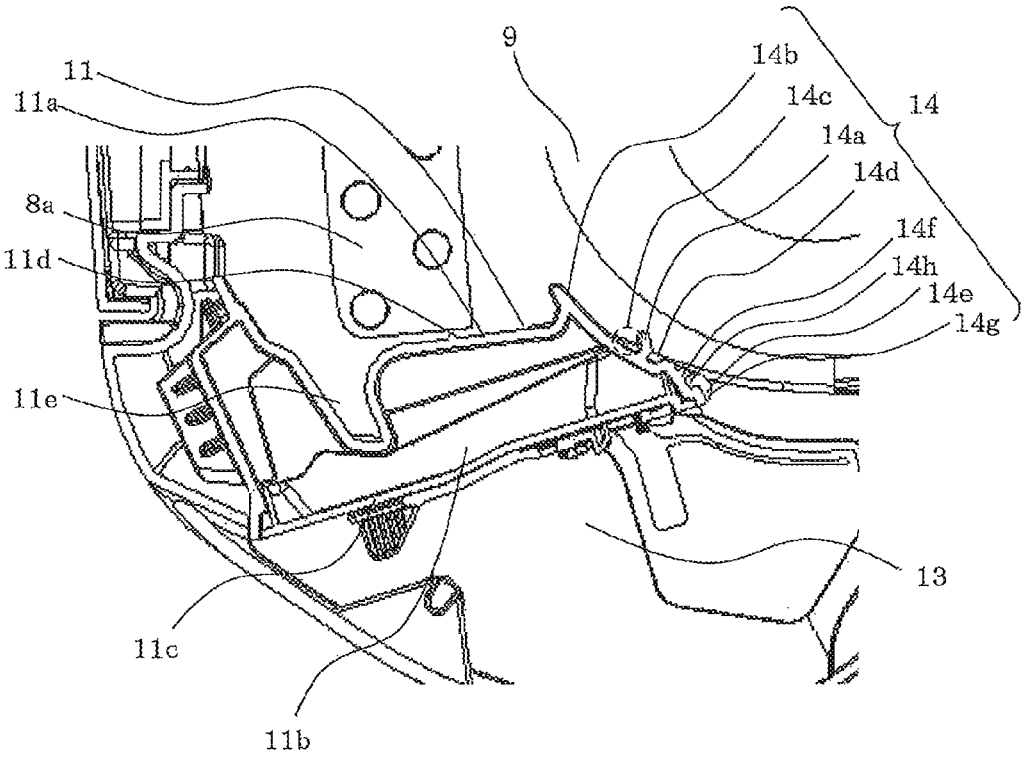
FIG. 3 is a schematic view of an essential part of the indoor unit of the air-conditioning apparatus according to Embodiment of the present invention.

FIG. 3 is a schematic view of an essential part of the indoor unit of the air-conditioning apparatus according to Embodiment of the present invention.

As shown in FIG. 3, the nozzle 11 is located on the lower side of the front heat exchanger 8*a* and disposed from the design grille 2 toward the cross flow fan 9. The upper surface of the nozzle 11 (on the side of the heat exchanger 8) forms a drain pan 11*a* which extends from a position substantially immediately below the front heat exchanger 8*a* toward the cross flow fan 9 and receives dew condensation water which is generated in the heat exchanger 8 during cooling operation or dehumidification operation. A nozzle projection 11*d* is disposed on a portion of the drain pan 11*a* and extends toward the front heat exchanger 8*a* which is located above. The nozzle projection 11*d* is disposed for ensuring a distance between the nozzle 11 and the front heat exchanger 8*a* and preventing the lower portion of the front heat exchanger 8*a* from being soaked in the dew condensation water which is dripped into the drain pan 11*a*, and also serves as a positioning mark during applying a cushion material, which is described later, between the drain pan 11*a* and the front heat exchanger 8*a*.

Further, a drainage groove 11*e* which projects downward is formed on a portion of the nozzle 11 which is located on the side of the design grille 2 with respect to the drain pan 11*a* such that dew condensation water dripped into the drain pan 11*a* flows into the drainage groove 11*e*. That is, the drain pan 11*a* and the drainage groove 11*e* is formed to be continuous by the upper surface of the nozzle 11, and the drain pan 11*a* is located on the side of the cross flow fan 9 with respect to the drainage groove 11*e*. The lower portion of the front heat exchanger 8*a* is prevented from being soaked in the water by allowing dew condensation water to flow from the drain pan 11*a* to the drainage groove 11*e*. Accordingly, the drain pan 11*a* has a portion which is downwardly inclined to the drainage groove 11*e* such that the dripped dew condensation water easily flows into the drainage groove 11*e*.

A nozzle cover 11*c* which forms a portion of the outlet air channel 13 is mounted on the lower surface of the nozzle 11 (on the side opposite to the heat exchanger 8) via an air layer 11*b*. Accordingly, the air layer 11*b* exists between the drain pan 11*a* and the nozzle cover 11*c* and serves as a heat insulation layer. As a result, even if the drain pan 11*a* is cooled by the dew condensation water which is generated in the heat exchanger 8, dew condensation of the nozzle cover 11*c* can be prevented.

However, when the air layer 11*b* is not completely sealed, dew condensation water is stored in the drainage groove 11*e*. Accordingly, an area around the drainage groove 11*e* is cooled and dew condensation intensively occurs on the back surface of the drainage groove 11*e*. Then, when dew condensation water is dripped on the upper surface of the nozzle cover 11*c*, the nozzle cover 11*c* is cooled and dew condensation occurs, and accordingly, dew condensation water tends to be generated on the back surface of the nozzle cover 11*c*. When the dew condensation water is dripped on an area around the air outlet 6 under the nozzle cover 11*c*, the dew is scattered into the room by an air blown from the air outlet 6.

Figure 7:
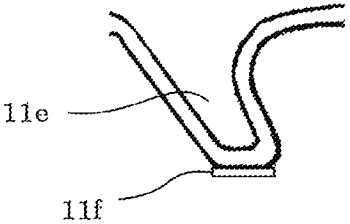
FIG. 7 is a partial schematic view of the drainage groove of FIG. 3 showing an alternative embodiment.

In this case, as illustrated in FIG. 7, at least one of a heat insulating material and a water absorbing material (hereinafter, referred to as a heat insulating material or the like) ll*f* can be applied on the back surface of the drainage groove 11*e* to prevent dew condensation water from being dripped on the upper surface of the nozzle cover 11*c*, and accordingly, dew condensation water can be prevented from being generated on the underside of the nozzle cover 11*c*. If the nozzle 11 has no drainage groove 11*e*, it is necessary to apply the heat insulating material 11*f* or the like across the entire back surface of the drain pan 11*a*. However, since the drainage groove 11*e* is provided in this embodiment, the heat insulating material 11*f* or the like may be applied only on the back surface of the drainage groove 11*e*. Accordingly, it is possible to prevent scattering of dew with reduced cost since the surface area for applying the heat insulating material or the like can be decreased compared with the case where no drainage groove 11*e* is provided.

The stabilizer 14 is disposed on the surface of the nozzle 11 which faces the cross flow fan 9 along part of the outer periphery of the cross flow fan 9. A tip portion 14*b* is disposed at the boundary between the stabilizer 14 and the nozzle 11, and a projection 14*a* is disposed at a lower position along the outer periphery of the cross flow fan 9 so as to define a minimum distance between the stabilizer 14 and the cross flow fan 9. A first recess 14*c* is formed between the projection 14*a* and the tip portion 14*b* as a continuously recessed shape in the longitudinal direction of the cross flow fan 9. Further, a second recess 14*d* is formed under the first recess 14*c* as a continuously recessed shape in the longitudinal direction of the cross flow fan 9.

Figure 4:
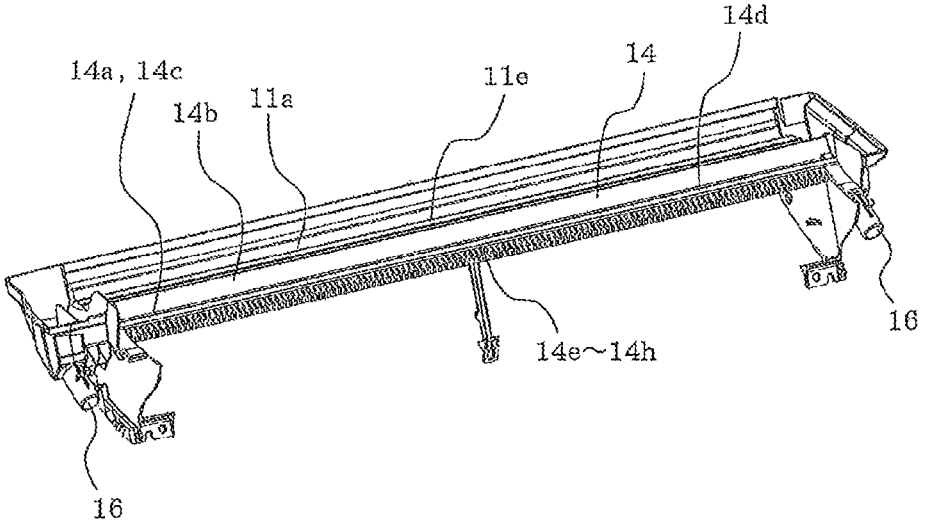
FIG. 4 is a perspective view of a stabilizer of the indoor unit of the air-conditioning apparatus according to Embodiment of the present invention.
Figure 5:
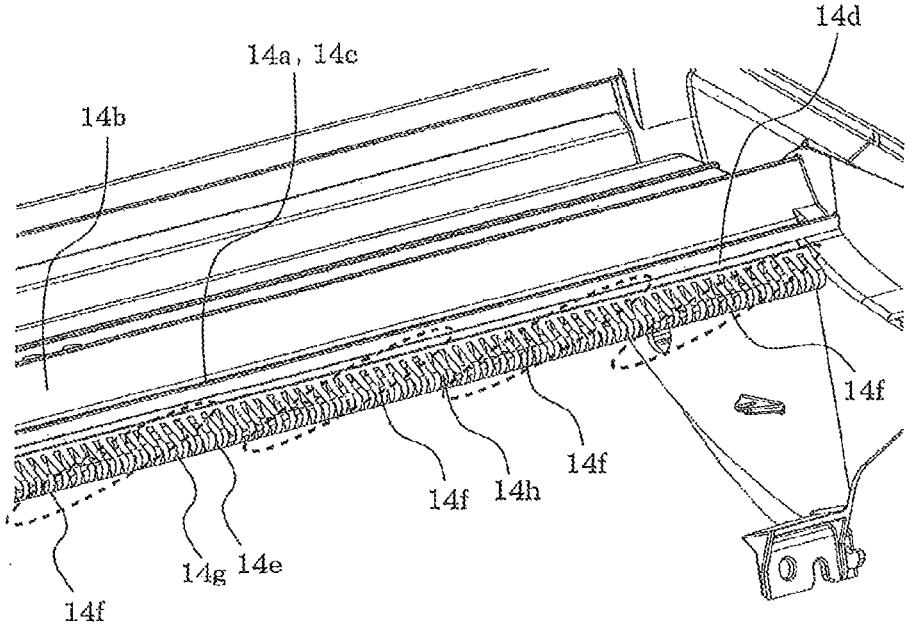
FIG. 5 is an enlarged view of an essential part of FIG. 4.

FIG. 4 is a perspective view of the stabilizer of the indoor unit of the air-conditioning apparatus according to Embodiment of the present invention, and FIG. 5 is an enlarged view of an essential part of FIG. 4.

A rounded section 14*g* which is in a convex shape curved toward the cross flow fan 9 is disposed at the boundary between the stabilizer 14 and the outlet air channel 13, and a plurality of vertical grooves 14*e* is arranged in the longitudinal direction of the cross flow fan 9 on the rounded section 14*g*. Further, vertical groove ribs 14*f* are formed on the plurality of vertical grooves 14*e* with their positions being regularly displaced in an oblique direction along the outer periphery of the cross flow fan 9. The vertical groove ribs 14*f* are located on part of the vertical grooves 14*e*, thereby forming a third recess 14*h*.

Next, an operation of the indoor unit 1 of the air-conditioning apparatus according to the embodiment during a cooling operation or dehumidification operation will be described.

When power is applied to the indoor unit 1 by using a remote controller or the like, which is not shown in the figure, and a cooling operation or a dehumidification operation is selected, a refrigerant becomes high temperature and high pressure by a compressor, which is not shown in the figure, and is then discharged. Then, the refrigerant becomes low temperature and low pressure via a condenser and an expansion valve, which are not shown in the figure, and then flows into the heat exchanger 8. When the cross flow fan 9 rotates, the room air is suctioned through the air inlet 4 and then flows into the heat exchanger 8 after dust is filtered out via a pre-filter 7. The air exchanges heat with the refrigerant in the heat exchanger 8, and then, the air is blown out through the air outlet 6 into the room. The air is blown out in the direction according to the positions of the up-and-down air flow direction variable vane 5 and the right-and-left air flow direction variable vane 15. Further, the positions of the up-and-down air flow direction variable vane 5 and the right-and-left air flow direction variable vane 15 may be set by a user manually or automatically by using a remote controller.

After that, the room air is again suctioned from the air inlet 4, and this sequence of operations is repeated. As a result, the air quality is changed since the room air is cooled while dust is removed.

When the room air is cooled or dehumidified while passing through the heat exchanger 8, moisture in the air is condensed in the heat exchanger 8 and dew condensation water is dripped on the drain pan 11*a*. Then, the dripped dew condensation water is guided to the drainage groove 11*e* by an inclination of the drain pan 11*a*, and is then discharged to the outside of the room through a drain hose, which is not shown in the drawings, connected to a drain hose mounting section 16. If the drainage groove 11*e* does not have a sufficient depth, dew condensation water overflows from the drainage groove 11*e* and causes the lower portion of the front heat exchanger 8*a* to be soaked in the dew condensation water. As a consequence, the room air fails to pass through the soaked lower portion, which decreases heat exchange efficiency. Therefore, it is necessary for the drainage groove 11*e* to have a sufficient depth.

As shown in FIG. 4, the drain hose mounting sections 16 are disposed on the right and left sides so that one of the drain hose mounting sections 16 is connected to the drain hose depending on an installation environment and the other is connected to a rubber plug. When the indoor unit 1 is inclined in the right and left direction due to distortion of the wall surface on which the indoor unit 1 is installed, deformation of mounting fittings or defect in installation work, the drain hose mounting section 16 which is connected to the drain hose may be located at a position higher than the lowest level of the drainage groove 11*e*. As a consequence, dew condensation water which is stored in the drainage groove 11*e* fails to be discharged from the drain hose to the outside. In such a case, it is also necessary for the drainage groove 11*e* to have a sufficient depth so as to prevent overflow of dew condensation water from the drainage groove 11*e* and prevent the lower portion of the front heat exchanger 8*a* from being soaked in the dew condensation water. An actual measurement has revealed that the drainage groove 11*e* having a depth of 2% or more of the horizontal width dimension of the indoor unit 1 can prevent overflow of dew condensation water even if the right and left inclination is 1.1 degrees, and this covers almost all the states of installation.

Even if the indoor unit 1 is inclined forward, dew condensation water can be guided to the drainage groove 11*e* by providing a sufficient inclination to the drain pan 11*a*. An actual measurement has revealed that the downward inclination angle toward the drainage groove 11*e* of 2 degrees or more can cover almost all the states of installation.

In the above configuration, since the lower portion of the front heat exchanger 8*a* can be prevented from being soaked in the dew condensation water, the room air can pass through the lower portion of the front heat exchanger 8*a*. Accordingly, heat exchange efficiency is prevented from being lowered during cooling operation and dehumidification operation.

Furthermore, since the boundary between the drainage groove 11*e* and the drain pan 11*a* has a shape which curves toward the front heat exchanger 8*a*, dew condensation water flows to the drainage groove 11*e* along the curved surface. Accordingly, when dew condensation water is dripped into the drainage groove 11*e*, dripping sound made by the dripped dew condensation water and water stored in the drainage groove 11*e* can be reduced.

In this Embodiment, as shown in FIG. 1, since the boundary between the drainage groove 11*e* and the drain pan 11*a* are located immediately under the front heat exchanger 8*a*, part of the drainage groove 11*e* is also located immediately under the front heat exchanger 8*a*. In this case, the boundary between the drainage groove 11*e* and the drain pan 11*a* is displaced on the side of the design grille 2 with respect to the position immediately under the heat exchanger 8 so that the drainage groove 11*e* is not located immediately under the front heat exchanger 8*a*. As a result, it is possible to prevent dew condensation water from being directly dripped from the front heat exchanger 8*a* into the drainage groove 11*e*. Accordingly, dripping sound can be further reduced.

In the case where a gap between the drain pan 11*a* and the front heat exchanger 8*a* (or the nozzle projection 11*d*) is large during cooling operation or dehumidification operation, air of high temperature and humidity which passes through the gap from the front side to the back side of the indoor unit 1 (hereinafter, referred to as secondary air) without passing through the heat exchanger 8 increases. The secondary air is cooled when passing by the tip portion 14*b* of the stabilizer 14 and generates dew condensation water on the tip portion 14*b*. When the amount of the dew condensation water increases, dew condensation water overflows from the tip portion 14*b* to an area around the air outlet 6 and causes scattering of dew into the room by an air blown from the air outlet 6.

In order to decrease the secondary air which causes dew condensation on the tip portion 14*b*, an actual measurement has revealed that the gap between the drain pan 11*a* and the front heat exchanger 8*a* (or the nozzle projection 11*d*) needs to be decreased, preferably to 2 mm or less. Further, the gap between the drain pan 11*a* and the front heat exchanger 8*a* may be sealed by placing a cushion material therebetween.

Accordingly, since the amount of the secondary air can be decreased, the amount of dew condensation water generated on the tip portion 14*b* can be decreased, thereby preventing dew condensation water from overflowing from the tip portion 14*b* and preventing scattering of dew.

Figure 6:
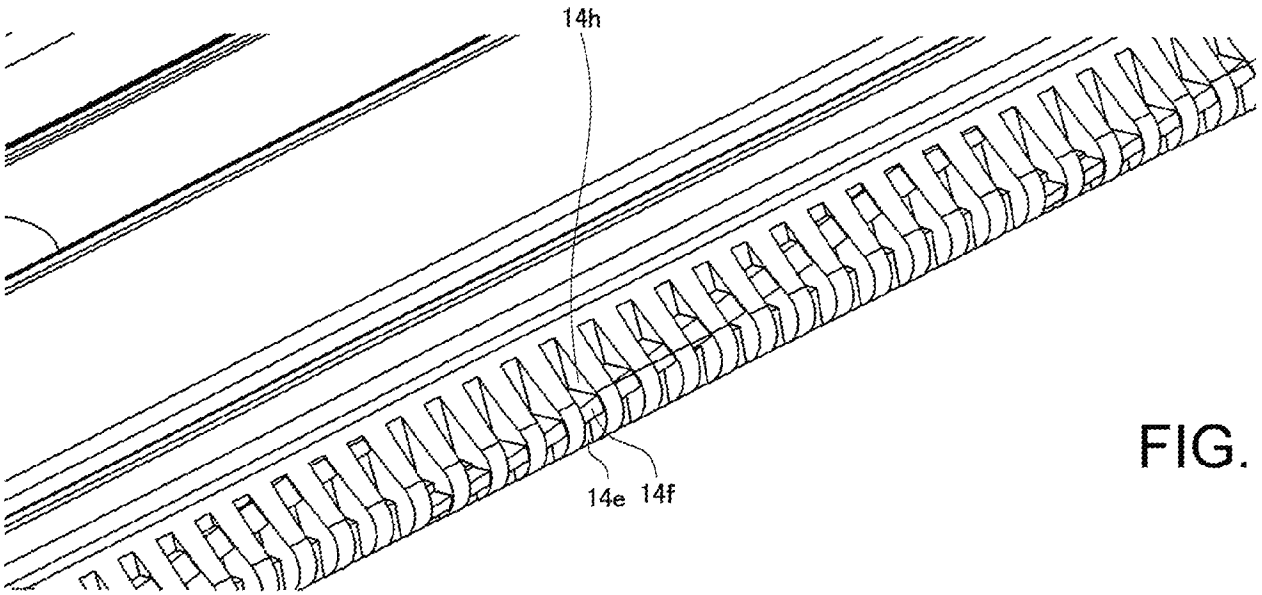
FIG. 6 is an enlarged perspective view of a portion of the stabilizer of FIGS. 4 and 5.

Even if dew condensation water is generated on the tip portion 14*b*, since the first recess 14*c* is formed between the projection 14*a* and the tip portion 14*b* to be continuous in the longitudinal direction of the cross flow fan 9, dew condensation water can be received in the first recess 14*c*. Further, since the second recess 14*d* is formed under the first recess 14*c* as a continuously recessed shape in the longitudinal direction of the cross flow fan 9, dew condensation water can be received in the second recess 14*d* even if dew condensation water overflows from the first recess 14*c*. Further, as shown in FIGS. 5 and 6, a plurality of vertical grooves 14*e* is formed on the rounded section 14*g*, the vertical groove ribs 14*f* are formed on the plurality of vertical grooves 14*e* with their positions being regularly displaced in an oblique direction along the outer periphery of the cross flow fan 9, and the vertical groove ribs 14*f* are located on part of the vertical grooves 14*e*, thereby forming the third recess 14*h*. Accordingly, overflowed dew condensation water can be received in the third recess 14*h*. As described above, the stabilizer 14 has three recesses of the first recess 14c, the second recess 14*d* and the third recess 14*h* such that dew condensation water is received by triple configuration. As a result, dew condensation water is prevented from overflowing from the stabilizer 14 to an area around the air outlet 6, and scattering of dew into the room by an air blown from the air outlet 6 can be received. Further, dew condensation water stored in the three recesses is evaporated during low load operation or shutdown of operation.

As described above, since the stabilizer 14 has three recesses, dew condensation water generated in the indoor unit 1 during cooling operation or dehumidification operation can be held in the three recesses so as not to be dripped on an area around the air outlet 6. Accordingly, scattering of dew into the room by an air blown from the air outlet 6 can be prevented.

Further, the amount of the secondary air can be decreased by providing a gap between the drain pan 11*a* and the front heat exchanger 8*a* (or the nozzle projection 11*d*) of 2 mm or less, thereby reducing the amount of dew condensation water generated at the tip portion 14*b* and preventing dew condensation water from overflowing form the tip portion 14*b*. Accordingly, scattering of dew can be prevented.

Further, the nozzle cover 11*c* can be mounted on the underside of the nozzle 11 via the air layer 11*b*, thereby allowing the air layer 11*b* between the drain pan 11*a* and the nozzle cover 11*c* to be provided as a heat insulating layer. Accordingly, when dew condensation water is generated on the underside of the nozzle cover 11*c* and the dew condensation water is dripped on an area around the air outlet 6, it is possible to prevent scattering of dew into the room by an air blown out from the air outlet 6.

Even if the air layer 11*b* is not completely sealed, the heat insulating material 11*f* or the like can be applied only on the back surface of the drainage groove 11*e* to prevent dew condensation water from being generated on the underside of the nozzle cover 11*c*. See FIG. 7. Accordingly, it is possible to prevent scattering of dew with reduced cost.

Further, the drain pan 11*a* and the drainage groove 11*e* are formed on the nozzle 11, and an inclination which is downwardly inclined toward the drainage groove 11*e* is formed on the drain pan 11*a* so that dew condensation water flows from the drain pan 11*a* to the drainage groove 11*e* and is stored in the drainage groove 11*e*, thereby preventing the lower portion of the front heat exchanger 8*a* from being soaked in water.

Further, even if the indoor unit 1 is inclined in the right and left direction and dew condensation water stored in the drainage groove 11*e* fails to be discharged through the drain hose to the outside, over flow of dew condensation water can be prevented in almost all the states of installation by providing the drainage groove 11*e* having a depth of 2% or more of the vertical width dimension of the indoor unit 1.

Further, even if the indoor unit 1 is inclined forward, dew condensation water can be guided to the drainage groove 11*e* in almost all the states of installation by providing the drain pan 11*a* having an inclination angle of 2 degrees or more.

The above configuration can prevent decrease of heat exchange efficiency due to the lower portion of the front heat exchanger 8*a* being soaked in the dew condensation water.

Further, since the boundary between the drainage groove 11*e* and the drain pan 11*a* has a shape which curves toward the front heat exchanger 8*a*, dew condensation water flows along the curved surface and the dripping sound when dew condensation water is dripped into the drainage groove 11*e* can be reduced.

Further, the drainage groove 11*e* is formed so that any portion of the drainage groove 11*e* is not located immediately under the heat exchanger 8. Accordingly, it is possible to prevent dew condensation water from being directly dripped from the heat exchanger 8 into the drainage groove 11*e*, thereby further reducing the dripping sound.

Moreover, in the heat exchanger 8, a heat transfer tube, which is not shown in the figure, may be made of aluminum.

Although copper is used for a heat transfer tube of the heat exchanger 8 in the conventional indoor unit 1, the heat transfer tube may be made of aluminum to reduce the cost of the heat exchanger 8. Further, since aluminum is more subject to corrosion compared with copper, an anticorrosion treatment should be performed taking into consideration that the lower portion of the front heat exchanger 8*a* is soaked in water. In this Embodiment, however, the lower portion of the front heat exchanger 8*a* is configured so as not to be easily soaked in the dew condensation water and the corrosion resistance of aluminum heat transfer tube can be increased, thereby reducing the cost of anticorrosion treatment.

REFERENCE SIGNS LIST

1 indoor unit 2 design grille 3 panel 4 air inlet 5 up-and-down air flow direction variable vane 6 air outlet 7 pre-filter 8 heat exchanger 8*a* front heat exchanger 9 cross flow fan 10 inlet air channel 11 nozzle 11*a* drain pan 11*b* air layer 11*c* nozzle cover 11*d* nozzle projection 11*e* drainage groove 12 box section 13 outlet air channel 14 stabilizer 14*a* projection 14*b* tip portion 14*c* first recess 14*d* second recess 14*e* vertical groove 14*f* vertical groove rib 14*g* rounded section 14*h* third recess 15 right-and-left air flow direction variable vane 16 drain hose mounting section

The invention claimed is:

1. An indoor unit of an air-conditioning apparatus comprising:

a fan;

a heat exchanger that is disposed to surround an upper side and a front side of the fan;

a nozzle that is disposed on a lower side of a portion of the heat exchanger that is located on the front side of the fan to face the fan; and a stabilizer that is disposed on a surface of the nozzle that faces the fan along part of an outer periphery of the fan, wherein the stabilizer has a tip portion at a boundary between the stabilizer and the nozzle and a projection on a lower side of the tip portion, wherein the tip portion projects to a side of the fan and has a portion that curves upward, and a first recess is formed between the projection and the tip portion in a continuously recessed shape in the longitudinal direction of the fan, and the stabilizer has a rounded section which is in a convex shape curved toward the fan at a boundary between the stabilizer and an outlet air channel which is disposed on a lower side of the fan, a plurality of vertical grooves are arranged in a longitudinal direction of the fan on the rounded section, vertical groove ribs are formed on the plurality of vertical grooves with positions of the vertical groove ribs being regularly displaced in an oblique direction along the outer periphery of the fan, and a third recess is formed by the vertical groove ribs which are located on part of the vertical grooves, wherein part of the nozzle forms a drainage groove, and a heat insulating material and a water absorbing material are applied on the drainage groove, and the insulating material and the water-absorbing material are applied to a lower surface of the nozzle beneath the drainage groove.

2. The indoor unit of the air-conditioning apparatus of claim 1, wherein the stabilizer has a second recess disposed on a lower side of the first recess in a continuously recessed shape in the longitudinal direction of the fan.

3. The indoor unit of the air-conditioning apparatus of claim 1, wherein the nozzle forms a drain pan that receives dew condensation water generated in the heat exchanger, and a gap between the drain pan and the portion of the heat exchanger that is located in front of the fan, is 2 mm or less.

4. The indoor unit of the air-conditioning apparatus of claim 1, wherein a nozzle cover is mounted on an underside of the nozzle via an air layer.

5. The indoor unit of the air-conditioning apparatus of claim 1, wherein a heat transfer tube of the heat exchanger is made of aluminum.

6. The indoor unit of the air-conditioning apparatus of claim 2, wherein the second recess has a bottom surface that is concave in cross-section such that the second recess can retain water when the air conditioning apparatus is in an installed position.

* * * * *